United States Patent [19]

Crawford et al.

[11] Patent Number: 4,540,539

[45] Date of Patent: Sep. 10, 1985

[54] METHOD AND APPARATUS FOR PRODUCTION OF CONCRETE PIPE BY THE PACKERHEAD METHOD

[75] Inventors: Gerald R. Crawford, Sergeant Bluff; Brian J. Kozlowski, Sioux City, both of Iowa

[73] Assignee: International Pipe Machinery Corp., Sioux City, Iowa

[21] Appl. No.: 451,666

[22] Filed: Dec. 21, 1982

[51] Int. Cl.[3] ..... B28B 21/26

[52] U.S. Cl. ..... 264/269; 264/312; 425/262; 425/427

[58] Field of Search ..... 425/427, 262, 426; 264/269, 312

[56] References Cited

U.S. PATENT DOCUMENTS

| | | | |
|---|---|---|---|
| 1,895,740 | 1/1933 | Ukropina | 425/426 |
| 1,938,230 | 12/1933 | Ukropina | 425/426 |
| 3,096,556 | 7/1963 | Woods | 425/262 |
| 3,276,091 | 10/1966 | Pausch | 425/262 |
| 3,632,270 | 1/1972 | Baker et al. | 425/262 |
| 3,733,163 | 5/1973 | Hermann | 425/262 |
| 3,746,494 | 7/1973 | Gauger | 425/262 |
| 4,340,553 | 7/1982 | Fosse | 425/262 |
| 4,407,648 | 10/1983 | Fosse | 425/262 |

FOREIGN PATENT DOCUMENTS

| | | | |
|---|---|---|---|
| 2738944 | 3/1979 | Fed. Rep. of Germany . | |
| 383861 | 1/1965 | Switzerland | 425/427 |

*Primary Examiner*—Jay H. Woo
*Assistant Examiner*—James C. Housel
*Attorney, Agent, or Firm*—James G. Staples

[57] ABSTRACT

A packerhead, a concrete pipe making machine having said packerhead, and a method of making concrete pipe are disclosed in which twist forces on the reinforcing wire cage of the pipe and concrete voids are eliminated by rotation of the longbottom and rollerhead portions of the packerhead in opposite directions. The peripheral speed of the system is also increased over conventional systems.

8 Claims, 5 Drawing Figures

PRIOR ART B

PRIOR ART A

METHOD AND APPARATUS FOR PRODUCTION OF CONCRETE PIPE BY THE PACKERHEAD METHOD

This invention relates to a method and apparatus for the production of concrete pipe by the packerhead system. It is particularly concerned with a packerhead, a concrete pipe making machine, and a method of making concrete pipe which yields greater production in a given unit of time, eliminates cage twist which is now a problem in the packerhead method of concrete pipe production, and eliminates concrete voids around the cage wire.

SUMMARY OF THE INVENTION

A packerhead for use in a concrete pipe making machine is provided which is bi-directional in operation in that the rollerhead (or wingblock frame) rotates independently, and, preferably, in the opposite direction of, the longbottom (or trowel). Specifically, the rollerhead and longbottom are rotated at different speeds in the same direction, or, preferably, in the same or different speeds in opposite directions. Further, the packing element peripheral speeds can be increased from the present practical maximum of about 12,000 inches per minute up to about 14,000 inches per minute on both small and large diameter concrete pipes, with the result that cage twist of the wires which form the reinforcing cage in the pipe is eliminated, and, simultaneously, concrete voids which are frequently if not invariably encountered in conventional systems (including dual packerhead systems) is eliminated.

DESCRIPTION OF FIGURES

The invention is illustrated more or less diagrammatically in the accompanying Figures wherein.

Like reference numerals will be used to refer to like parts from Figure to Figure throughout the description of the drawing.

DESCRIPTION OF SPECIFIC EMBODIMENT

Figure 1:
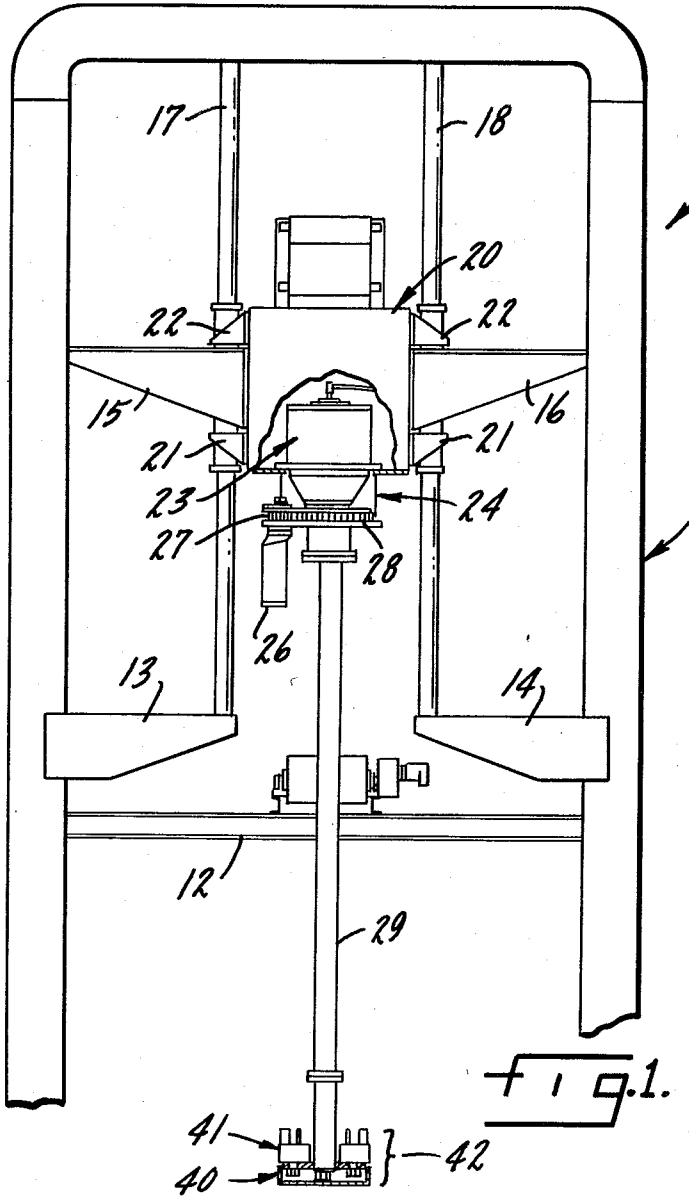
FIG. 1 is an elevation, with parts broken away for clarity, of a concrete pipe making machine which includes the new and unique packerhead disclosed herein.

Referring first to FIG. 1, a concrete pipe making machine is indicated generally at 10. The machine includes a generally inverted U-shaped main frame 11 which includes a horizontal platform 12 and horizontal members 13, 14, 15, and 16 and vertical members 17 and 18.

A crosshead is indicated generally at 20, the crosshead being supported from horizontal members 15 and 16 and vertical members 17 and 18 by means of clamps or U-shaped connecting members 21, 22.

A gear box is indicated at 23. A drive unit assembly which may, if desired, be an auxiliary rollerhead drive system is indicated at 24, the auxiliary roller drive system (sometimes hereafter referred to as ARDS) being bolted to and depending downwardly from the gear box 23.

The ARDS includes a hydraulic motor 26 which powers a drive pinion 27 which in turn drives a gear 28. The gear 28 in turn is connected to and drives the hollow rollerhead drive shaft 29, shown best in FIG. 2.

Figure 2:
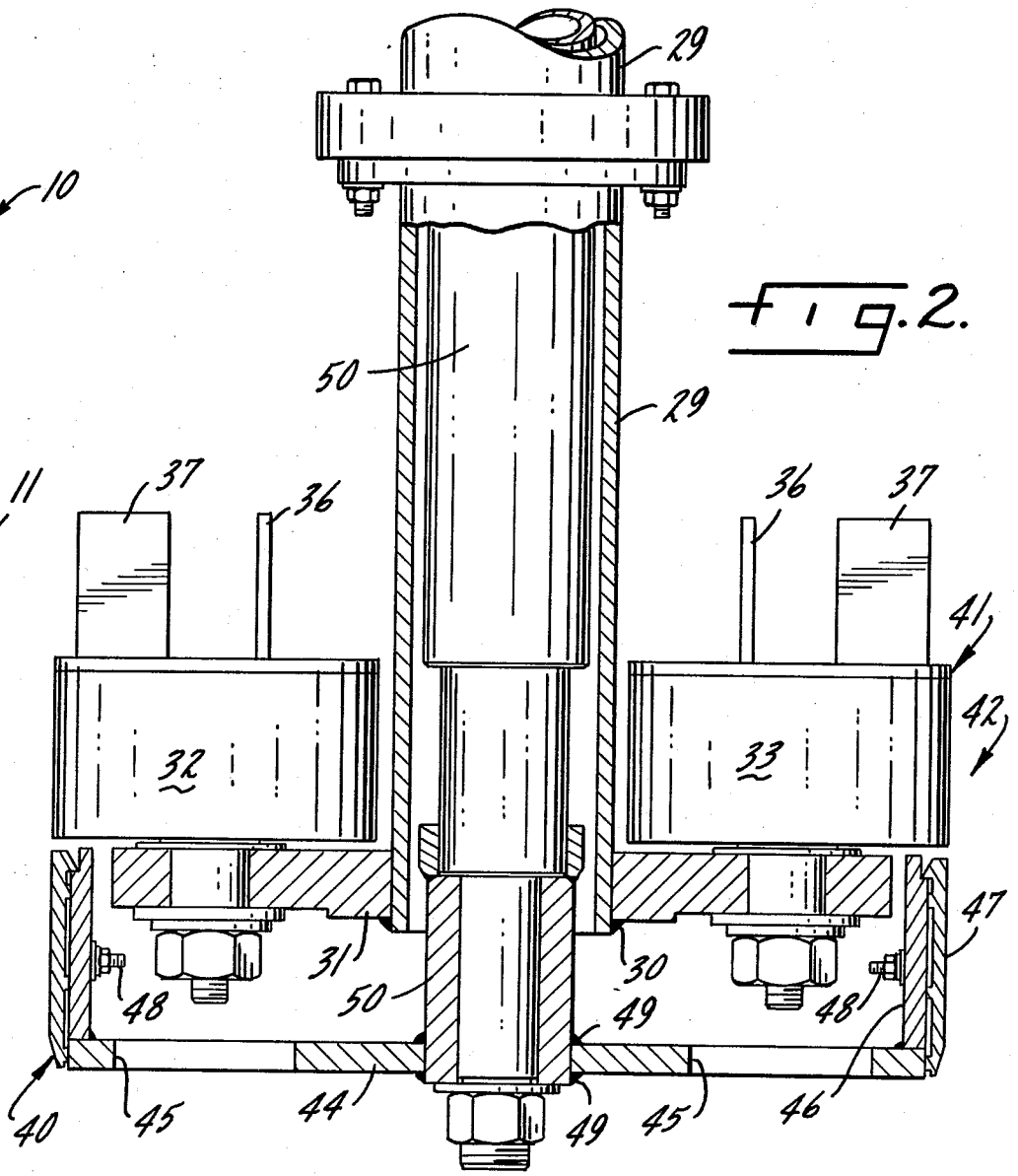
FIG. 2 is a section through the packerhead of this invention to an enlarged scale as compared to FIG. 1.

Referring now to FIG. 2, it will be seen that the rollerhead drive shaft 29 is secured, as by welds 30, to a circular roller mounting plate 31 on which a plurality of rollers 32, 33, 34, and 35 (see FIG. 5 for rollers 34 and 35) may be mounted. It will be understood that any desirable number of rollers may be employed. The rollers may include any type and number of distributing blades 36, 37.

A longbottom assembly is indicated generally at 40, the longbottom assembly and the rollerhead, indicated generally at 41, together with their respective drive means, comprising, collectively, the bi-directional packerhead 42 of this invention.

The longbottom assembly includes a circular bottom plate 44 having apertures 45 therein for ready access to the rollers 32–35. A mounting flange is indicated at 46, the mounting flange carrying a smooth, circular roller distributor blade or troweling member 47 which is secured entirely around the periphery of the mounting flange 46 by any suitable fastening means 48.

Circular bottom plate 44 is welded, as at 49, to a longbottom drive shaft indicated at 50. Gear box 23 is arranged to drive the longbottom assembly 40 in a direction opposite to the direction of rotation of the rollerhead 41.

The use and operation of the invention is as follows.

The packerhead and drive shafts of FIG. 1 are lowered into a concrete pipe mold in which a conventional reinforcing wire cage has been inserted. The packerhead is lowered to the bottom of the mold at the commencement of the cycle. Material is then fed to the packhead which is rotated at a peripheral speed greater than 12,000 inches per minute for all diameters of pipe.

The aforesaid speed refers to the peripheral speed of the longbottom assembly 40. If desired, the material feed is controlled by automatic modulation so as to maintain a constant production but the process can be run successfully with a manually operated material feed.

Figure 5:
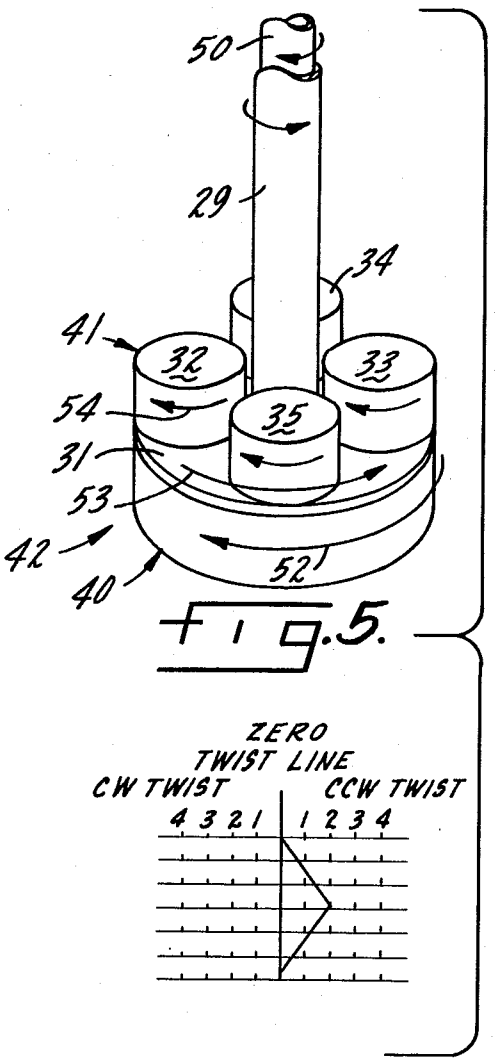
FIG. 5 is a diagrammatic view of the packerhead of this invention which further shows the resultant twist on the reinforcing wire cage of a concrete pipe undergoing production.

The direction of rotation of the longbottom assembly is indicated by the arrow 52 in FIG. 5.

Simultaneously with rotation of the longbottom assembly, and the longbottom drive shaft 50, rollerhead 41 and specifically circular roller mounting plate 31, is rotated in the opposite direction by the roller head drive shaft 29. Preferably, the direction of rotation is indicated by arrow 53 in FIG. 5. Individual rollers 32–35 are rotated in a direction opposite to the basic direction of rotation of the rollerhead 41, as indicated by arrows 54.

As a result of this mode of operation, the system approaches a condition of zero twisting or torque forces on the reinforcing cage of the concrete pipe, as illustrated by the force diagram which forms the lower portion of FIG. 5.

Specifically, and referring to that diagram, the legend "CW TWIST" refers to clockwise twist, and the legend "CCW TWIST" refers to counter clockwise twist, with the twists being imposed on the wires of the reinforcing cage. The reference numerals "1"–"4" refer to the degree or magnitude of twist imposed on the wires in the reinforcing cage and may be thought of, conceptually, in units of inches per inch, or inches per foot, of length of the packerhead assembly. In the illustrated embodiment, the rollerhead assembly 41 can be visualized as imparting a counter clockwise twist of a magnitude of "2" on the reinforcing cage, which counter clockwise twist is cancelled by the oppositely directed clockwise twist of the longbottom 40, with the result that zero twist is imparted to the wire cage.

The vertical dimension of the twist diagram may be visualized as the depth of the bi-directional packerhead assembly 42. In actual operation, the imposition of the counter clockwise and the clockwise twists are occurring simultaneously and may, at any given instant in time, overlay one another with respect to the points of application of the twists to the wire cage so that the forces effectively cancel out one another at all times. The illustrated force diagram indicates the maximum adverse condition, including a maximum degree of twist of "2".

Figure 3:
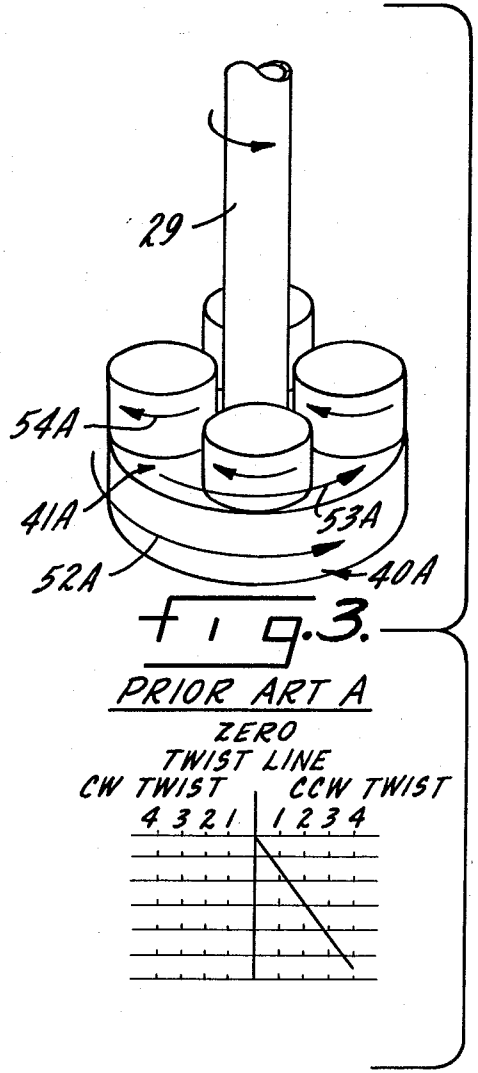
FIG. 3 is a diagrammatic view of a very common prior art packerhead, which shows the resultant twist on the reinforcing wire cage of the pipe.

By contrast, in FIG. 3, the conventional single stage rollerhead is illustrated which indicates that the only twisting forces applied to the reinforcing cage are counter clockwise twisting forces with no counter acting clockwise twist forces.

As a result the magnitude of twist is approximately twice that of the illustrated and described system, as represented by a comparison of the force diagrams of FIGS. 3 and 5. In FIG. 3, the longbottom assembly, rollerhead assembly and longbottom and rollerhead directions of rotations have been indicated by the reference numerals used in FIG. 5 with a capital A suffix added.

Figure 4:
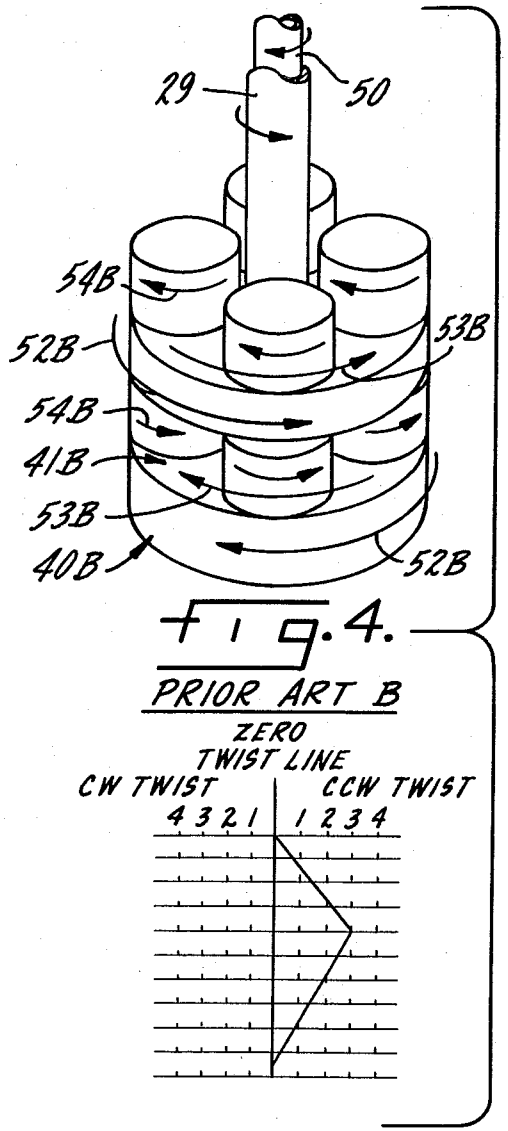
FIG. 4 is a diagrammatic view of another prior art packerhead system, in this instance, a dual packerhead arrangement, which further shows the resultant twist on the reinforcing wire cage of the pipe.

In FIG. 4, the conventional dual packerhead system is illustrated, this system consisting essentially of two single rollerhead systems of the type illustrated in FIG. 3 stacked one above the other. As those skilled in the art appreciate, this system is cumbersome because the excessive stack height makes production of the bell of the pipe very difficult, and requires compensating adjustments on both packerheads to eliminate cage twist. Cage twist can however be eliminated as illustrated in the force diagram of FIG. 4 wherein it will be noted that the degree of twist is at a magnitude of approximately "3" as contrasted to the "2" magnitude of FIG. 5.

In FIG. 4, each part which is similar to the parts of the embodiment of FIG. 5 have been indicated by the same reference numeral with the suffix "B".

It will thus be seen that the structure and method of this invention as illustrated in FIGS. 1, 2 and 5, results in the application of zero twisting forces to the reinforcing cage of a concrete pipe during production thereof, without the cumbersome mechanical arrangement inherent in a dual packerhead system and at a fraction of the cost thereof, with the further beneficial results of eliminating concrete voids and enabling an increased operational speed of as much as approximately 17% to be obtained over a wide range of both small and large diameter pipes.

Although a preferred embodiment of the invention has been illustrated and described, it will at once be apparent to those skilled in the art that modifications may be made within the spirit and scope of the invention. Accordingly it is intended that the scope of the invention be limited not by the foregoing description but solely by the hereafter appended claims when interpreted in light of the pertinent prior art.

We claim:

1. In a wire reinforced concrete pipe making machine, means for inserting a reinforcing wire cage in said concrete pipe mold, a bi-directional packerhead assembly, said bi-directional packerhead assembly consisting of a longbottom, means for causing rotation of said longbottom in a first direction as said bi-directional packerhead traverses a reinforcing wire cage located within a concrete pipe mold, a rollerhead, said rollerhead consisting of a roller carrying assembly and a plurality of rollers mounted on said roller carying assembly, and means for causing rotation of said rollerhead in a direction opposite to the direction of rotation of the longbottom at a peripheral speed such as to counteract the twist imposed on the reinforcing wire cage as said bi-directional packerhead traverses the reinforcing wire cage located within said concrete pipe mold.

2. In a wire reinforced concrete pipe making machine, a bi-directional packerhead assembly, said bi-directional packerhead assembly consisting of a longbottom, means for causing rotation of said longbottom in a first direction as said bi-directional packerhead traverses a reinforcing wire cage located within a concrete pipe mold, a rollerhead, said roller head consisting of a roller carrying assembly and a plurality of rollers mounted on said roller carying assembly, and means for causing rotation of said rollerhead in a directional opposite to the direction of rotation of the longbottom at a peripheral speed substantially equal to the peripheral speed of said longbottom.

3. The wire reinforced concrete pipe making machine of claim 2 further including means for inserting a reinforcing wire cage in said concrete mold.

4. The packerhead assembly of claim 1 or claim 2 further characterized by and including means for rotating the rollers on the roller carrying assembly in a direction opposite to the direction of rotation of the rollerhead.

5. A high speed method of making reinforced concrete pipe comprising the steps of traversing a packerhead vertically through a reinforcing wire cage located within a concrete pipe mold, applying a first troweling force to concrete fed to the upper side of the packerhead and centrifically placed about the cage in the mold, said troweling force being applied in a first direction of rotation, to lay up the concrete, applying a second troweling force to the laid up concrete at a location below the application of the first troweling force, said second troweling force being applied in a direction of rotation opposite to that of the first direction of rotation at a peripheral speed such as to counteract the twist imposed on the reinforcing wire cage, said first and second troweling forces being applied to the concrete by means carried by the packerhead.

6. The method of making reinforced concrete pipe of claim 5 further characterized in that the first troweling force is applied from a rollerhead assembly consisting of a single rollerhead, and the second troweling force is applied from a longbottom assembly consisting of a single longbottom.

7. The method of claim 5 further characterized in that the peripheral speed of the means which apply at least one of the troweling forces is about 14,000 inches per minute.

8. The method of making reinforced concrete pipe of of claim 7 further characterized in that the first troweling force is applied by a plurality of rollers whose vertical axis of rotation move in said first direction of rotation.

* * * * *

Disclaimer 4,540,539 - Gerald R. Crawford, Sergeant Bluff; Brian J. Kozlowski, Sioux City, both of Iowa. METHOD AND APPARATUS FOR PRODUCTION OF CONCRETE PIPE BY THE PACKERHEAD METHOD. Patent dated Sept. 10, 1985. Disclaimer filed Oct. 27, 1997, by the assignee, International Pipe Machinery Corporation.

Hereby enters this disclaimer to claim 5 of said patent.

*(Official Gazette,* December 28, 1999)